US008820385B2

(12) United States Patent
Wu

(10) Patent No.: US 8,820,385 B2
(45) Date of Patent: Sep. 2, 2014

(54) CONTROL DEVICE FOR CORDLESS BLIND WITH WILLFUL STOP

(75) Inventor: Cheng-Ming Wu, Kaohsiung (TW)

(73) Assignee: Bao Song Precision Industry Co., Ltd., Kaohsiung (TW)

( * ) Notice: Subject to any disclaimer, the term of this patent is extended or adjusted under 35 U.S.C. 154(b) by 173 days.

(21) Appl. No.: 13/468,299

(22) Filed: May 10, 2012

(65) Prior Publication Data

US 2013/0233499 A1 Sep. 12, 2013

(30) Foreign Application Priority Data

Mar. 7, 2012 (TW) ..... 101204117 A
Mar. 27, 2012 (TW) ..... 101110640 A

(51) Int. Cl.
*E06B 9/305* (2006.01)

(52) U.S. Cl.
USPC ..... 160/173 R; 160/170

(58) Field of Classification Search
CPC ..... E06B 9/322
USPC ..... 160/170, 171, 168.1 R, 173 R, 84.04, 160/298
See application file for complete search history.

(56) References Cited

U.S. PATENT DOCUMENTS

| | | | | |
|---|---|---|---|---|
| 5,375,643 | A * | 12/1994 | Rude | 160/321 |
| 6,158,563 | A * | 12/2000 | Welfonder et al. | 192/223.3 |
| 6,164,428 | A * | 12/2000 | Berman et al. | 192/223.4 |
| 7,866,367 | B2 * | 1/2011 | Liang et al. | 160/173 R |
| 2004/0144500 | A1 * | 7/2004 | Nien | 160/170 |
| 2007/0261798 | A1 * | 11/2007 | Hung et al. | 160/170 |
| 2008/0210387 | A1 * | 9/2008 | Yang | 160/168.1 V |
| 2010/0006236 | A1 * | 1/2010 | Liang et al. | 160/170 |
| 2011/0253321 | A1 * | 10/2011 | Yu et al. | 160/170 |
| 2011/0290429 | A1 * | 12/2011 | Cheng | 160/84.02 |
| 2012/0048485 | A1 * | 3/2012 | Fu-Lai et al. | 160/331 |

* cited by examiner

*Primary Examiner* — Katherine Mitchell
*Assistant Examiner* — Scott Denion
(74) *Attorney, Agent, or Firm* — Muncy, Geissler, Olds & Lowe, P.C.

(57) ABSTRACT

Disclosed is a control device for a cordless blind with willful stop at any positions according to user needs during switching operation. The control device primarily comprises a force-return mechanism, a shaft connector, and a braking buffer mechanism which are all installed inside a same housing. The force-return mechanism has a flat spring bevel gear and an elastic element. One end of the shaft connector is a transmission bevel gear meshed with the flat spring bevel gear. The braking buffer mechanism includes a friction ring and an impeding spring where the friction ring is immovably fixed inside the housing with a wear-proof annular inwall. The impeding spring is tightly plugged into the friction ring with an extrusion to prevent the rotation of the transmission bevel gear. Specifically, the shaft connector has a trigger to change the friction between the impeding spring and the friction ring.

15 Claims, 12 Drawing Sheets

CONTROL DEVICE FOR CORDLESS BLIND WITH WILLFUL STOP

FIELD OF THE INVENTION

The present invention relates to a control device for a stationary or mobile switching mechanism installed in window openings of a building, more specifically to a control device for a cordless blind with willful stop.

BACKGROUND OF THE INVENTION

Blinds of early days were controlled through cords where a switching controller was installed at one end of the track located on top of a blind. A bead chain or a cord was handing down from the switching controller to lift or lower the blind by pulling the bead chain. However, accidents of strangling small children by the bead chains have been occurred, therefore, blinds with bead chains have been forbidden in many countries. Hence, cordless blinds become household necessities. Even though there are many different designs of cordless blinds, the switching operation is not as convenient as blinds with cords.

The major issues of conventional cordless blinds are the slats only can fully open or fully close and conventional cordless blinds can not be stopped at any position according to user needs. Furthermore, the stopping control device of a cordless blind is customized and is designed and manufactured according to the weight and dimension of a cordless blind. If stopping control device does not match with the cordless blind, the cordless blind will either suddenly drop to hurt someone below or completely lift without fully close. Moreover, when the stopping control device of a cordless blind is worn after used in years, the elastic element of the force-return mechanism becomes fatigued leading to always fully close of the cordless blind.

SUMMARY OF THE INVENTION

Therefore, the main purpose of the present invention is to provide a control device for a cordless blind with willful stop to enable switching of lifting/lowering a cordless blind at any position according to user needs, moreover, the elastic element inside will not become fatigued leading to always fully close of the cordless blind.

The second purpose of the present invention is to provide a control device for a cordless blind with willful stop to avoid suddenly dropping of a blind to hurt someone below and to lift the cordless blind with less force.

The third purpose of the present invention is to provide a control device for a cordless blind with willful stop where a blind transmission rod can go through the shaft connector to connect a plurality of control devices for a cordless blind with willful stop so that different numbers of control devices for a cordless blind with willful stop will be able to implement to different requirements of cordless blinds without redesigning the control device for a cordless blind with willful stop to achieve universal modularized installation.

According to the present invention, a control device for a cordless blind with willful stop is disclosed, primarily comprising a force-return mechanism, a shaft connector, and a braking buffer mechanism which are all installed inside a same housing. The force-return mechanism has at least a flat spring bevel gear and an elastic element. One end of the elastic element is connected to the flat spring bevel gear to provide elastic force to restore the position of the flat spring bevel gear. The shaft connector is installed inside the housing where one end of the shaft connector is a transmission bevel gear meshed with one bevel gear of the flat spring bevel gear. The other end of the shaft connector is a first inserting opening. The braking buffer mechanism installed inside the housing includes a friction ring and an impeding spring where the friction ring is immovably fixed inside the housing with a wear-proof annular inwall. The impeding spring is tightly plugged into the wear-proof annular inwall with an extrusion to prevent the rotation of the transmission bevel gear. Therefore, through the assembly combination of the braking buffer mechanism and the shaft connector, the cordless blind will be able to stop at any position during lifting/lowering operation.

DETAILED DESCRIPTION OF THE INVENTION

With reference to the attached drawings, the present invention is described by means of the embodiment(s) below where the attached drawings are simplified for illustration purposes only to illustrate the structures or methods of the present invention by describing the relationships between the components and assembly in the present invention. Therefore, the components shown in the figures are not expressed with the actual numbers, actual shapes, actual dimensions, nor with the actual ratio. Some of the dimensions or dimension ratios have been enlarged or simplified to provide a better illustration. The actual numbers, actual shapes, or actual dimension ratios can be selectively designed and disposed and the detail component layouts may be more complicated.

Figure 1:
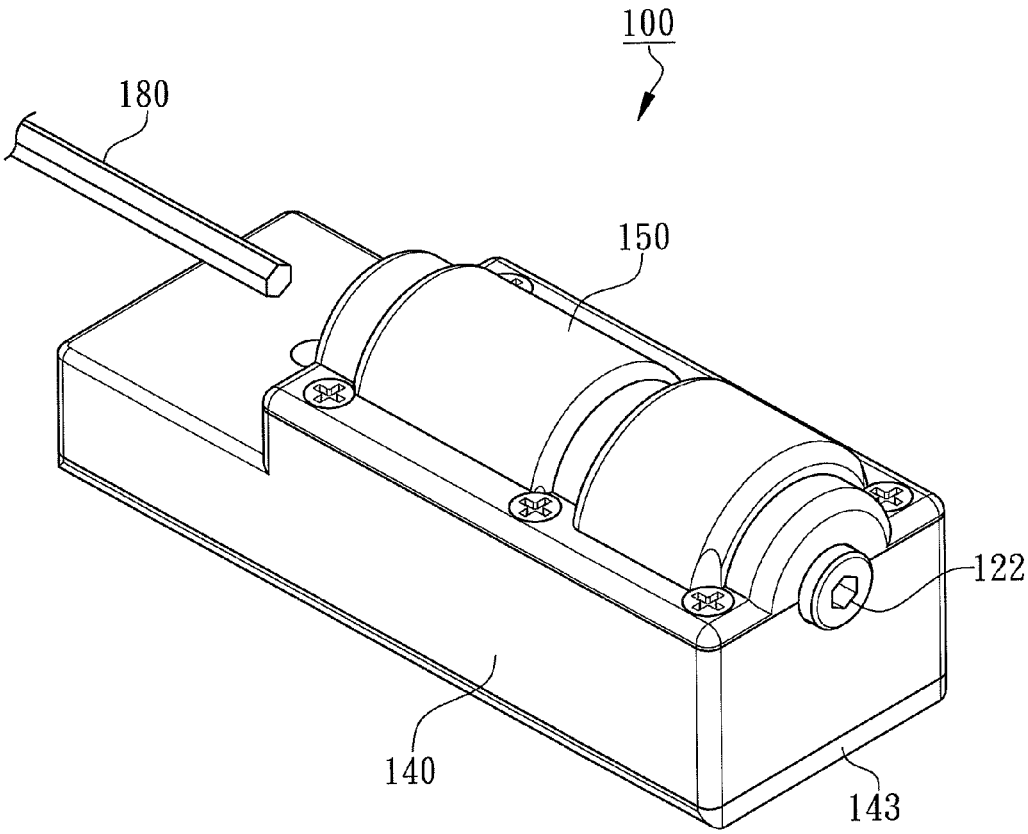
FIG. 1 is a three-dimensional view of a control device for a cordless blind with willful stop according to the first embodiment of the present invention.
Figure 2:
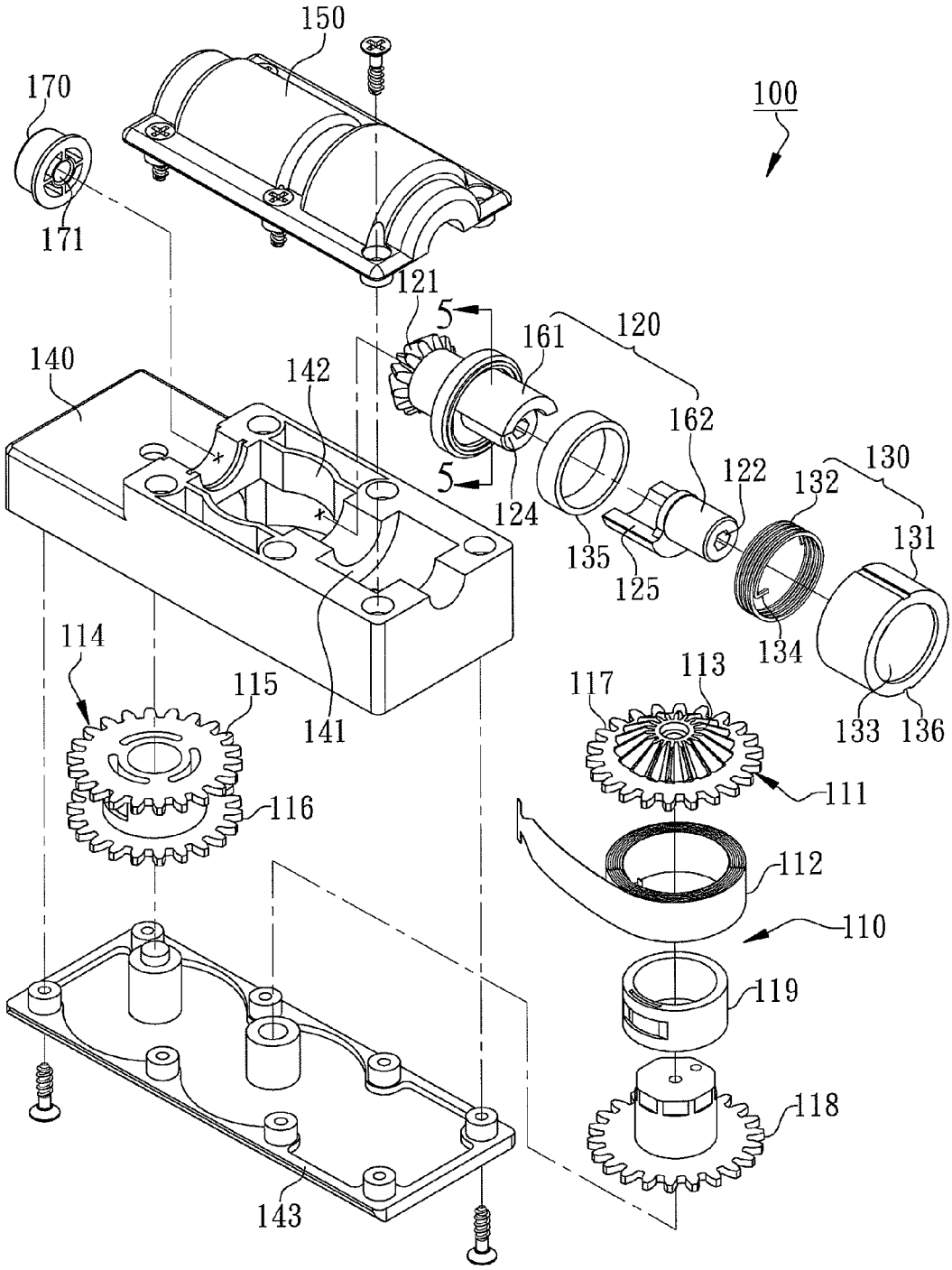
FIG. 2 is a three-dimensional disassembled component view of the control device according to the first embodiment of the present invention.
Figure 3:
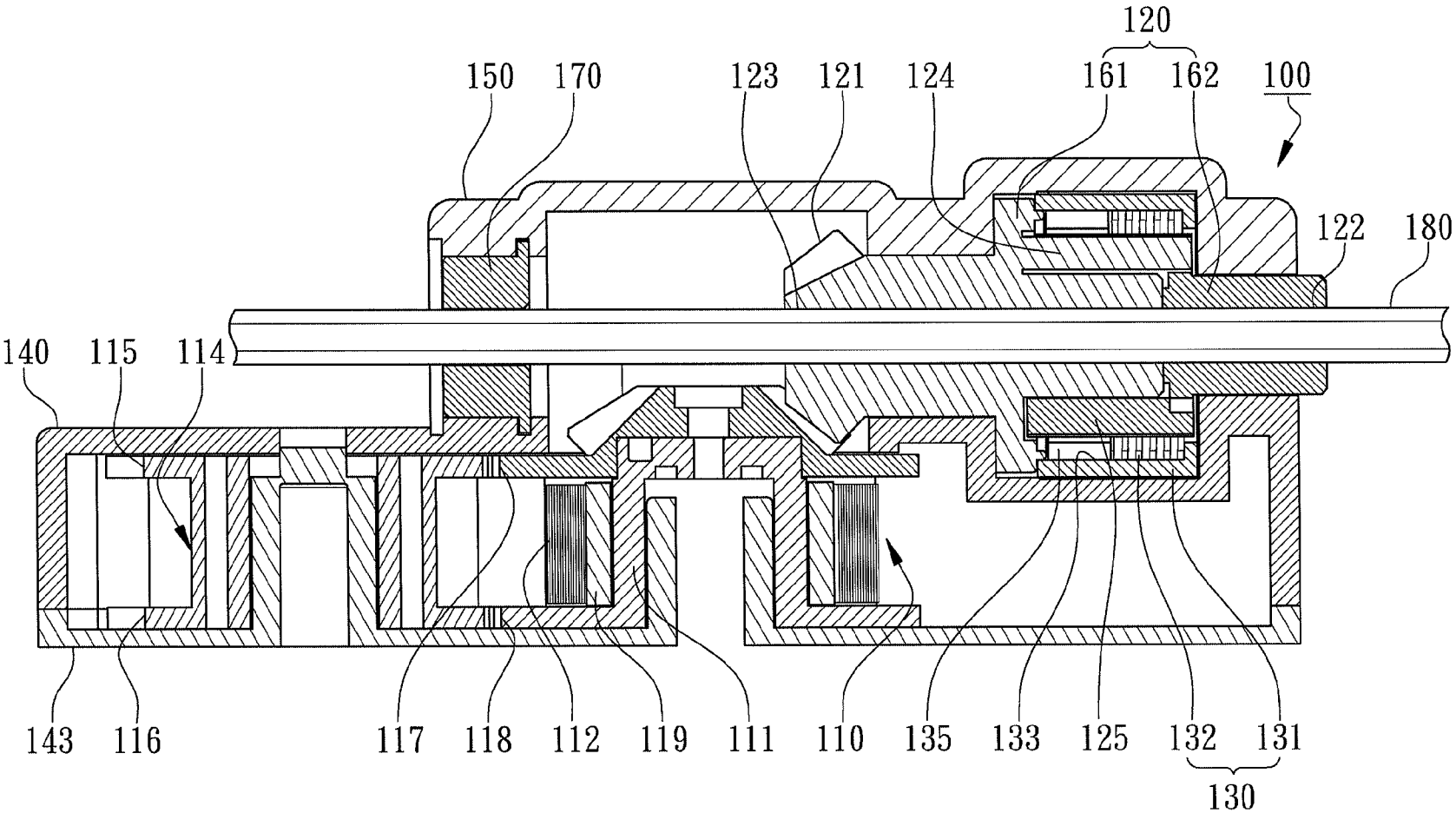
FIG. 3 is an axially cross-sectional view of the control device according to the first embodiment of the present invention.
Figure 4:
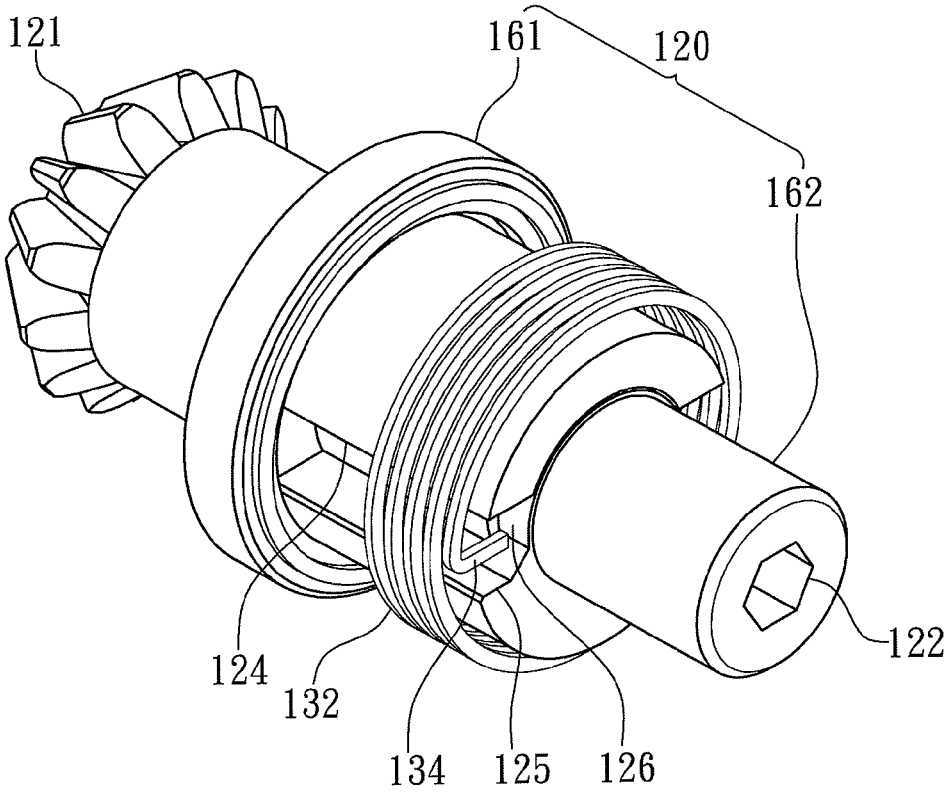
FIG. 4 is a three-dimensional view of a shaft connector and an impeding spring of the control device according to the first embodiment of the present invention.
Figure 5:
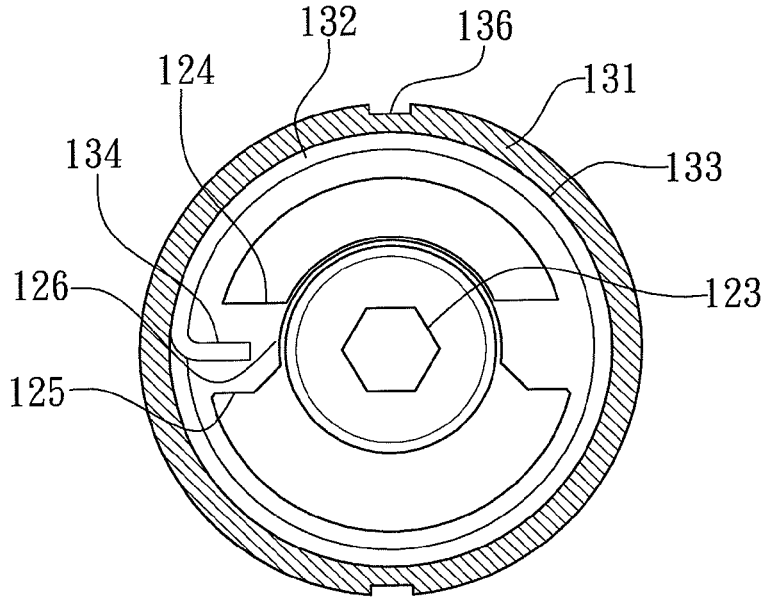
FIG. 5 is a cross-sectional view of the shaft connector and the impeding spring of the control device along 5-5 cross-sectional line in FIG. 2 according to the first embodiment of the present invention.

According to the first embodiment of the present invention, a control device 100 for a cordless blind with willful stop is illustrated in FIG. 1 for a three-dimensional view, FIG. 2 for a three-dimensional disassembled component view, FIG. 3 for a cross-sectional view, FIG. 4 for a partial enlarged three-dimensional view of its shaft connector and its impeding spring, and FIG. 5 for a partial cross-sectional view of FIG. 2.

The control device 100 primarily comprises a force-return mechanism 110, a shaft connector 120, and a braking buffer mechanism 130. The force-return mechanism 110 is designed to provide retracting forces to open a cordless blind. As shown in FIG. 2 and FIG. 3, the force-return mechanism 110 is installed inside a housing 140 where the force-return mechanism 110 at least includes a flat spring bevel gear 111 and an elastic element 112. The front end of the flat spring bevel gear 111 has a bevel gear 113 and one end of the elastic element 112 is connected to the flat spring bevel gear 111 to provide retracting force. For example, a sleeve 119 or spring gear is disposed under the flat spring bevel gear 111 and one end of the elastic element 112 is installed inside the fixing hole of the sleeve 119. In the present embodiment, the elastic element 112 can be a coil spring and the force-return mechanism 110 further includes a reed gear 114 where the other end of the elastic element 112 is connected to the reed gear 114. The elastic element 112 provide a retracting force under the flat spring bevel gear 111 so when the blind is lowering down, the elastic element 112 would retract from the reed gear 114 to provide a retracting force. Furthermore, the housing 140 has a base plate 143 to position the axes of the flat spring bevel gear 111 and the reed gear 114 so that the installation of the force-return mechanism 110 would not interfere the installation of the shaft connector 120. Preferably, a first gear 115 and a second gear 116 are installed respectively on top of and on bottom of the reed gear 114, moreover, a third gear 117 is installed at the periphery of the bevel gear 113 of the flat spring bevel gear 111 and a fourth gear 118 is installed under the flat spring bevel gear 111. The first gear 115 is meshed with the third gear 117 and the second gear 116 is meshed with the fourth gear 118 so that the elastic element 112 is confined between the top meshed plane formed by the first gear 115 and the third gear 117 and the bottom meshed plane formed by the second gear 116 and the fourth gear 118 to firmly hold the elastic element 112 in place without dropping out and losing its retracting force.

The shaft connector 120 is configured for connecting with a blind transmission rod 180 to move along with the lifting/lowering switch of the blind. As shown in FIG. 2 and FIG. 3, the shaft connector 120 is also installed inside the housing 140 where one end of the shaft connector 120 has a transmission bevel gear 121 meshed to the bevel gear 113 of the flat spring bevel gear 111. The other end of the shaft connector 120 has a first inserting opening 122 for inserting the blind transmission rod 180. When the blind transmission rod 180 rotates, the shaft connector 120 also rotates and vice versa.

The braking buffer mechanism 130 is also installed inside the housing 140 and includes a friction ring 131 and an impeding spring 132. The friction ring 131 is immovably fixed inside the housing 140 and has a wear-proof annular inwall 133. For example, at least an alignment fillister 136 is axially formed on an external sidewall of the friction ring 131 where the housing 140 and/or the shell 150 has a corresponding alignment bar to firmly fix the friction ring 131 inside the housing 140. The impeding spring 132 is tightly plugged into the wear-proof annular inwall 133 of the friction ring 132 with an extrusion 134 to prevent transmission bevel gear 121 from rotation. Therefore, through the assembly combination of the braking buffer mechanism 130 and the shaft connector 120, the cordless blind is able to stop at any position during lifting/lowering operation.

In the present embodiment, the extrusion 134 may be a protrusion sticking out toward the axis of the impeding spring 132 where the trigger 124 and the brake 125 are inserted through the impeding spring 132. Preferably, the braking buffer mechanism 130 further includes a restraining ring 135 inserted at the opening end of the wear-proof annular inwall 133 to prevent the impeding spring 132 to drop out.

Furthermore, in the present embodiment, the shaft connector 120 consists of a first separating element 161 and a second separating element 162 where a three-dimensional view of the first separating element 161 and the second separating element 162 are shown in FIG. 2 and FIG. 4. The transmission bevel gear 121 is disposed on the first separating element 161 where the first separating element 161 has a trigger 124. The first inserting opening 122 is formed on the second separating element 162 and penetrates through the axis of the first separating element 161 to the transmission bevel gear 121 to form a second inserting opening 123 on the transmission bevel gear 121 as shown in FIG. 3. Therefore, when the blind transmission rod 180 is inserted through the first inserting opening 122 and the second inserting opening 123 so that the first separating element 161 and the second separating element 162 are penetrated through and connected together, then the first separating element 161 and the second separating element 162 can be rotated synchronously. Moreover, the second separating element 162 has a brake 125 and the extrusion 134 is located at the gap 126 between the trigger 124 and the brake 125 where the trigger 124 and the brake 125 are assembled with the impeding spring 132 in a manner that the friction between the impeding spring 132 and the friction ring 131 is reduced when the trigger 124 is in contact with the extrusion 134. As shown in FIG. 2 and FIG. 4 again, the brake 125 and the trigger 124 are two sidewalls of separated extruded arcs facing to each other. As shown in FIG. 5, the extrusion 134 is integrally connected to the counterclockwise coil part of the impeding spring 132, the extrusion 134 of the trigger 124 is located at clockwise side and the brake 125 is located at counterclockwise side. When the trigger 124 contacts the extrusion 134, the impeding spring 132 will be stretched with slightly increase of coil counts to relatively make the diameter of the impeding spring 132 smaller so that the friction between the impeding spring 132 and the friction ring 131 can be reduced. Therefore, less force will be needed to rotate the shaft connector 120 and the trigger 124 counterclockwise. On the contrary, when the brake 125 contacts the extrusion 134, the impeding spring 132 will be pressed to make the diameter of the impeding spring 132 larger, however, the increase of the diameter of the impeding spring 132 is confined by the friction ring 131 so that the friction between the impeding spring 132 and the friction ring 131 will be the same or become slightly larger. Therefore, the clockwise rotation of the trigger 124 has to overcome the friction between the impeding spring 132 and the friction ring 131, or the shaft connector 120 would remain stationary.

To be more specific, the control device 100 further comprises a shell 150 integrated to the housing 140 to form two chambers, that is, a first chamber 141 and a second chamber 142. Therein, the braking buffer mechanism 130 is accommodated in the first chamber 141, moreover, the flat spring bevel gear 111 and the transmission bevel gear 121 is accommodated in the second chamber 142. Additionally, the shaft connector 120 penetrates through the first chamber 141 and the second chamber 142 of the housing 140 until the first inserting opening 122 is exposed from an opening formed by the combination of the housing 140 and the shell 150. Thus, the axial movement of the shaft connector 120, the transmission bevel gear 121, and the braking buffer mechanism 130 can be limited and avoided to ensure the transmission bevel gear 121 can effectively meshed with the bevel gear 113 of the flat spring bevel gear 111.

To be more specific, the control device 100 further comprises a guiding element 170 disposed between the housing 140 and the shell 150 where the guiding element 170 has a guiding hole 171 which is axially aligned to the first inserting opening 122 for the insertion of the blind transmission rod 180. In the present embodiment, the blind transmission rod 180 penetrates through the shaft connector 120 sticking out from the first inserting opening 122 where the shape of the first inserting opening 122 is corresponding to the shaft of the blind transmission rod 180 which is not circular such as tetragon, hexagon, or sliced circle.

Figure 6:
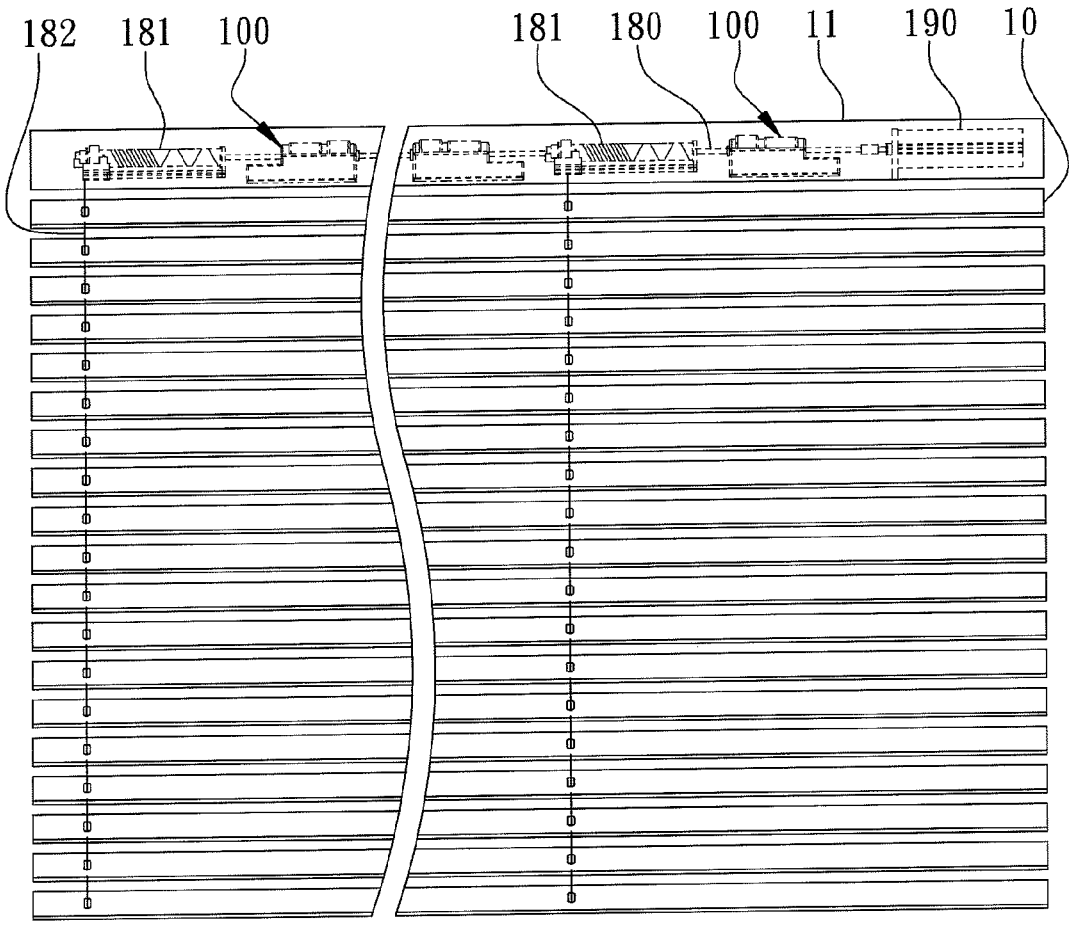
FIG. 6 is an illustration of implementing the control device installed in a cordless blind according to the first embodiment of the present invention.
Figure 7:
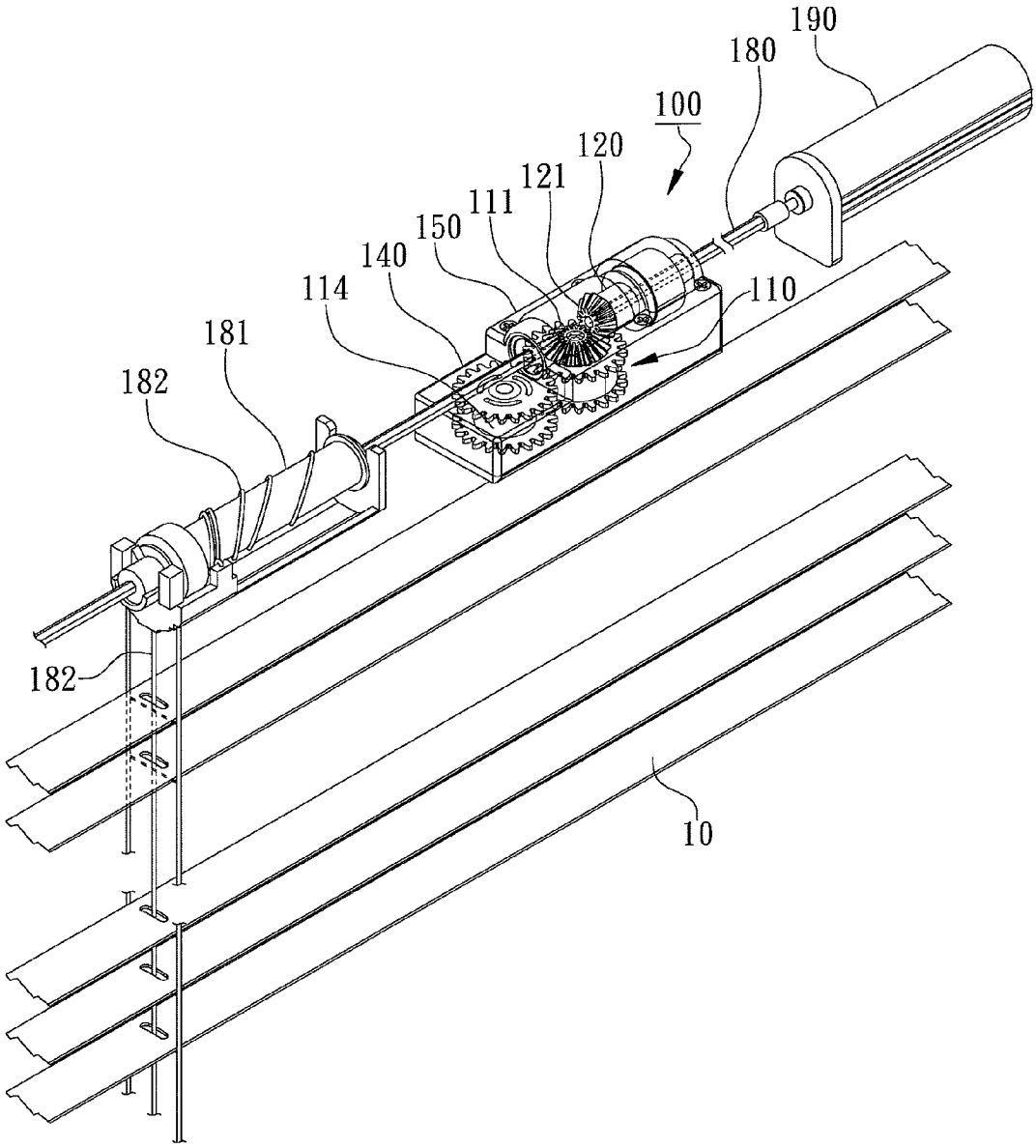
FIG. 7 is a three-dimensional view of implementing the control device installed in a cordless blind according to the first embodiment of the present invention.
Figure 8:
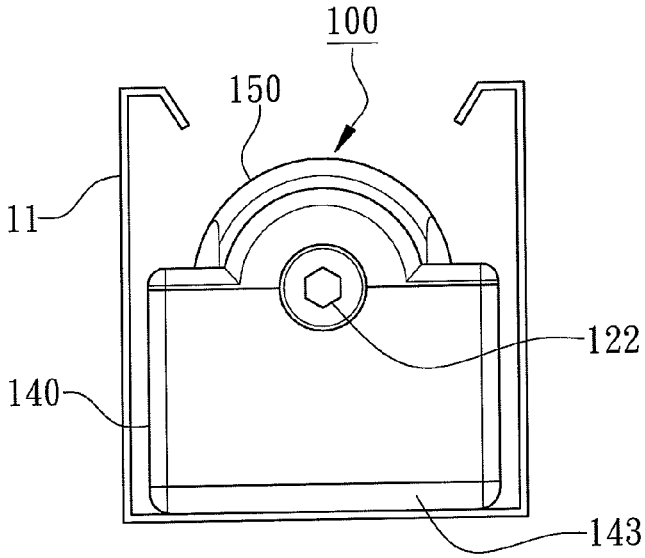
FIG. 8 is a side view of implementing the control device installed in a cordless blind according to the first embodiment of the present invention.

As shown in FIG. 6 and FIG. 7, the control device 100 can be installed in a cordless blind 10. As shown in FIG. 8, the control device 100 can be fixed in a blind fixing bar 11 by clipping or by screwing. The blind transmission rod 180 not only penetrates through the shaft connector 120 but also connects to a string spool 181 where the string spool 181 is able to retract or release the blind string 182. As the blind transmission rod 180 rotates, the blind string 182 is gradually collected in the string spool 181 to lift the cordless blind 10 to be open. When the blind string 182 is released from the string spool 181, the cordless blind 10 is lowered and closed. The control device for a cordless blind with willful stop is able to stop the cordless blind 10 at any position according to user needs. Since the shaft connector 120 is penetrated through by the blind transmission rod 180, a plurality of control devices 100 for a cordless blind with willful stop can be installed on top of the cordless blind 10 where the number of the control devices 100 can be freely adjusted corresponding to the weights and dimensions of the cordless blind 10 to achieve universal and easy modularized installation without any expensive customization.

As shown in FIG. 7 again, preferably, the control device 100 further comprises a transmission motor 190 connected to one end of the blind transmission rod 180 to further reduce the force needed to switch the cordless blind 10 where automatic switching the cordless blind 10 can be achieved. Therefore, manually or automatically switching the cordless blind 10 can be installed and implemented in the same cordless blind 10.

Figure 9:
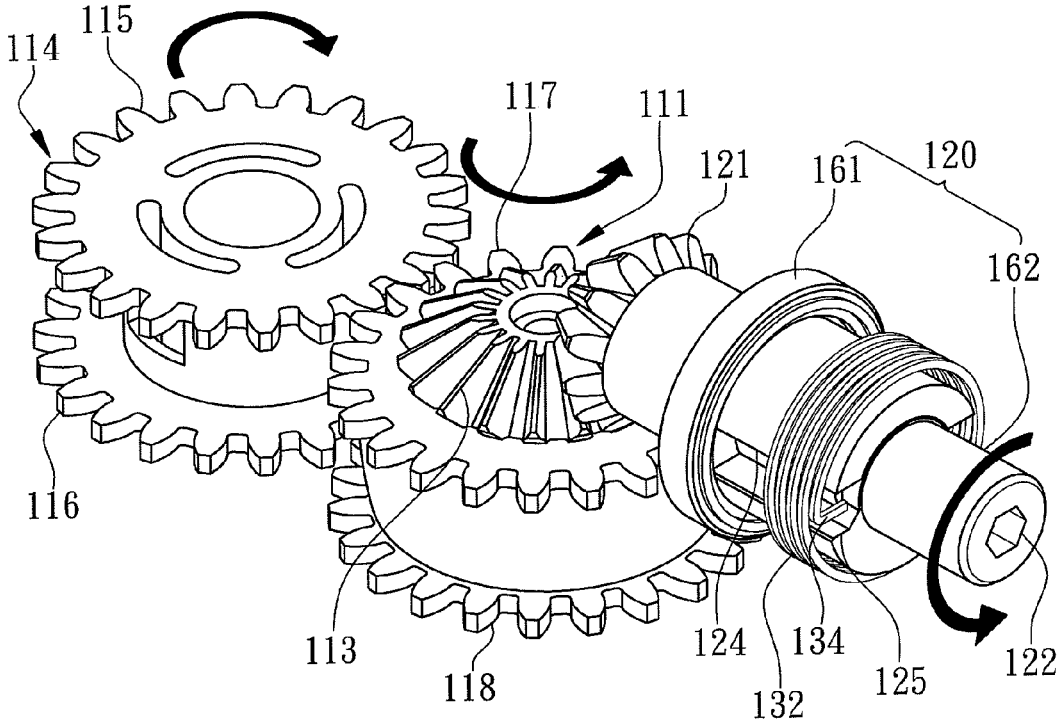
FIG. 9 is an illustration of restoring the position of a force-return mechanism, the shaft connector, and the impeding spring of the control device according to the first embodiment of the present invention.
Figure 10:
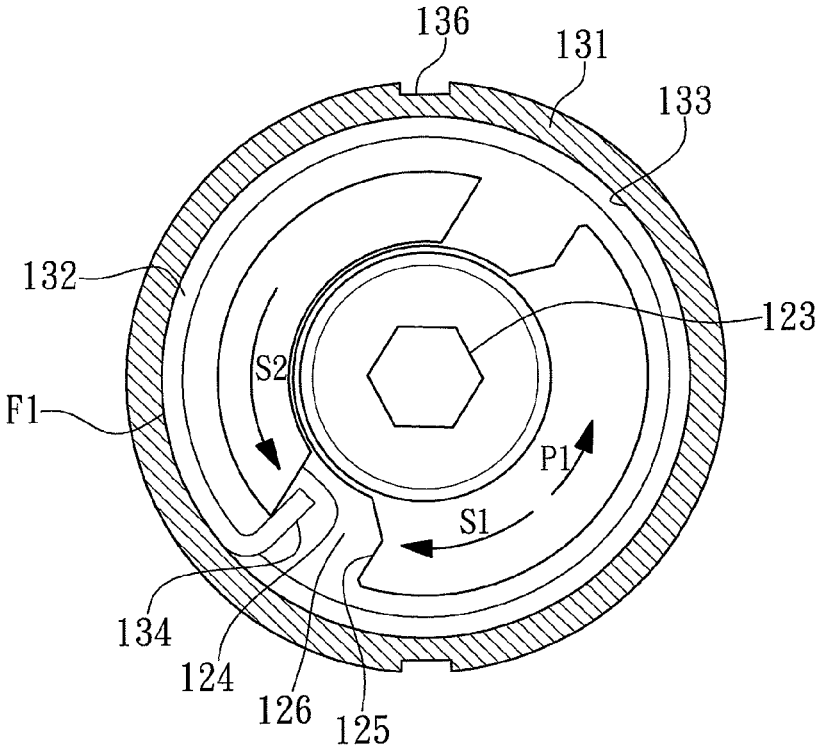
FIG. 10 is a radially cross-sectional view illustrating the shaft connector and a braking buffer mechanism of the control device when lifting the cordless blind according to the first embodiment of the present invention.

When lifting the cordless blind 10, the elastic element 112 in the control device 100 for a cordless blind with willful stop should be retracted under the flat spring bevel gear 111. As shown in FIG. 9 along with FIG. 10, since the flat spring bevel gear 111 is meshed with the transmission bevel gear 121, the horizontal counterclockwise rotation of the flat spring bevel gear 111 would rotate the shaft connector 120 in the vertical counterclockwise direction. As shown in FIG. 10, when a lifting force P1 exerted at the cordless blind 10 by a user, once the retracting force S2 from the elastic element 112 is greater than the remaining force of the blind gravity S1 minus the lifting force P1, i.e., S2>(S1−P1), the trigger 124 of the shaft connector 120 would contact the extrusion 134 of the impeding spring 132 to slightly increase coil counts of the impeding spring 132 which relatively make the diameter of the impeding spring 132 smaller. Therefore, the friction between the impeding spring 132 and the friction ring 131 becomes smaller, the reduced friction force F1 as shown in FIG. 10. When the friction ring 131 is stationary, the shaft connector 120 and the impeding spring 132 rotate in the vertical counterclockwise direction as shown in FIG. 10 so that much less force is needed to lift the cordless blind 10 where the force balance equation should be S2>(S1−P1)+F1. Once the lifting force P1 becomes smaller and the force balance equation becomes S2 (S1−P1)+F1, then the cordless blind 10 is able to stop at any position when it is lifted.

Figure 11:
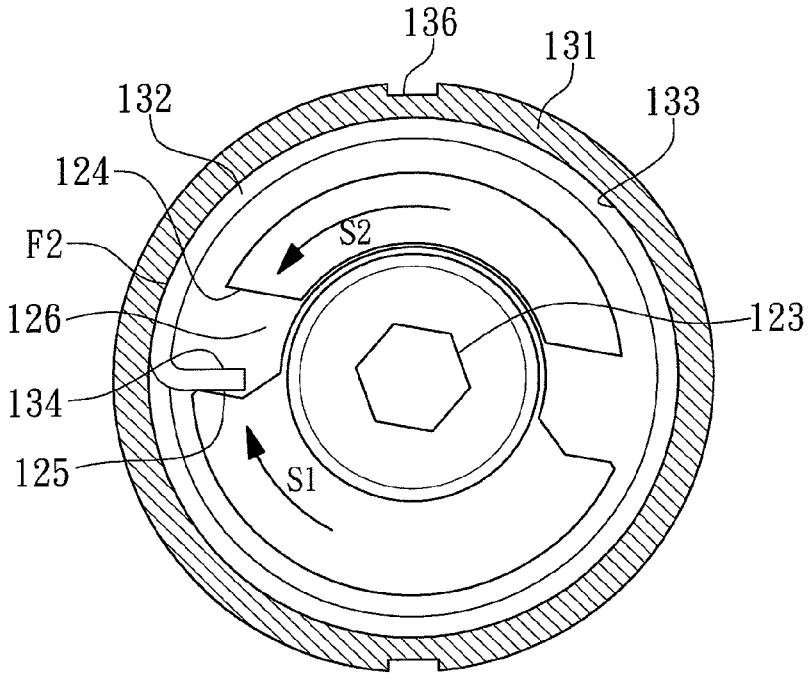
FIG. 11 is a radially cross-sectional view illustrating the shaft connector and the braking buffer mechanism of the control device when stopping the cordless blind according to the first embodiment of the present invention.

As shown in FIG. 11, when stopping the cordless blind 10 at any position without any exerted forces from a user, the blind gravity S1 is slightly greater than the retracting force S2 from the elastic element 112, i.e., (S1>S2), where the shaft connector 120 intends to rotate in the vertical clockwise direction, however, the brake 125 of the shaft connector 120 is in contact with the extrusion 134 of the impeding spring 132 to make the coil number of the impeding spring 132 unchanged or make the impeding spring 132 stretched. Then, the friction between the impeding spring 132 and the friction ring 131 is able to keep constant where the original friction F2 force is shown in FIG. 11 and F2>F1. Moreover, when the blind gravity S1 is greater, the original friction force F2 is further increased because that the impeding spring 132 intends to expand where the force balance equation should be S1 (S2+F2). Therefore, when the friction ring 131 and the impeding spring 132 are stationary, the shaft connector 120 would not rotate so that the cordless blind 10 is able to stop at any position.

Figure 12:
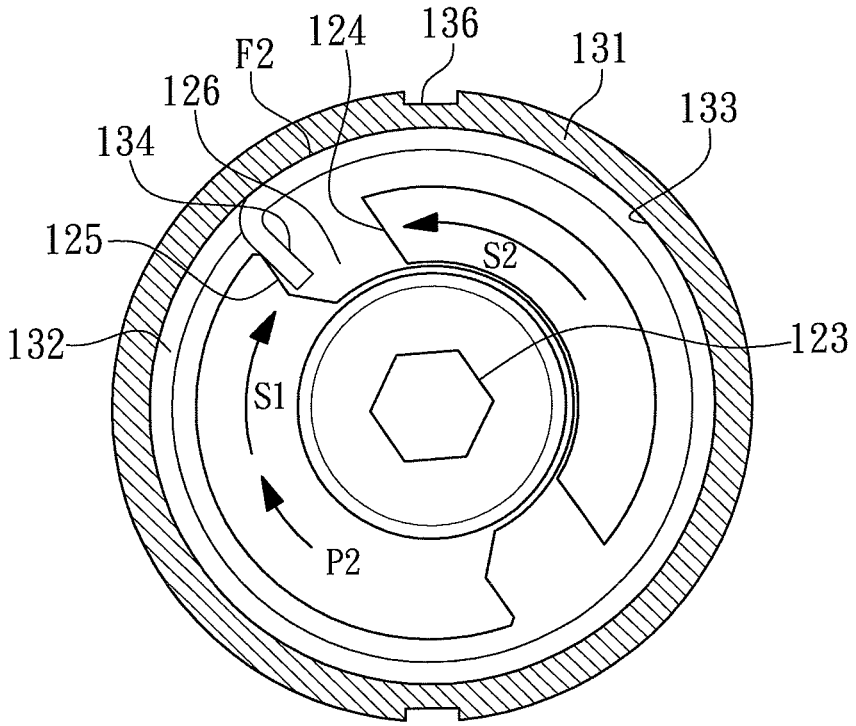
FIG. 12 is a radially cross-sectional view illustrating the shaft connector and the braking buffer mechanism of the control device when lowering the cordless blind according to the first embodiment of the present invention.

Furthermore, as shown in FIG. 12, when lowering the cordless blind, a lowering force P2 is exerted by a user which is in the same clockwise direction as the blind gravity S1. Because that the flat spring bevel gear 111 is meshed with the transmission bevel gear 121 and the flat spring bevel gear 111 rotates in the horizontal counterclockwise direction which would rotate the shaft connector 120 in the vertical counterclockwise direction so that the retracting force S2 is caused by the elastic element 112. Once the total force of the blind gravity S1 plus the lowering force P2 is greater than the total force of the retracting force S2 plus the original friction F2, i.e., (S1+P2)>(S2+F2), where the brake of the shaft connector 120 is in contact with the extrusion 134 of the impeding spring 132 so that the shaft connector 120 and the impeding spring 132 are able to rotate in the vertical clockwise direction to lower or/and close the cordless blind where the cordless blind 10 is able to stop at any position when it is lowered.

Figure 13:
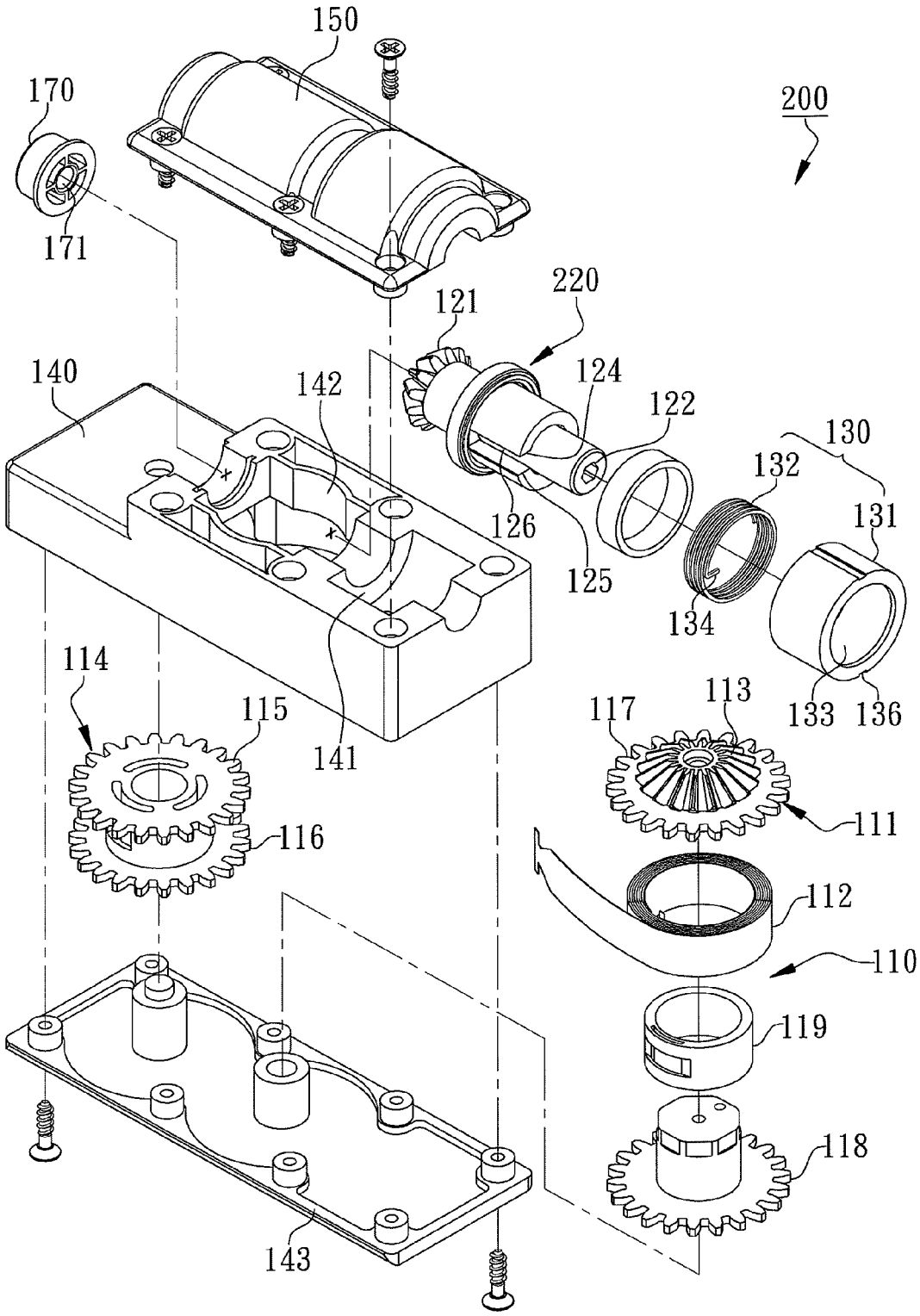
FIG. 13 is a three-dimensional disassembled component view of another control device for a cordless blind with willful stop according to the second embodiment of the present invention.
Figure 14:
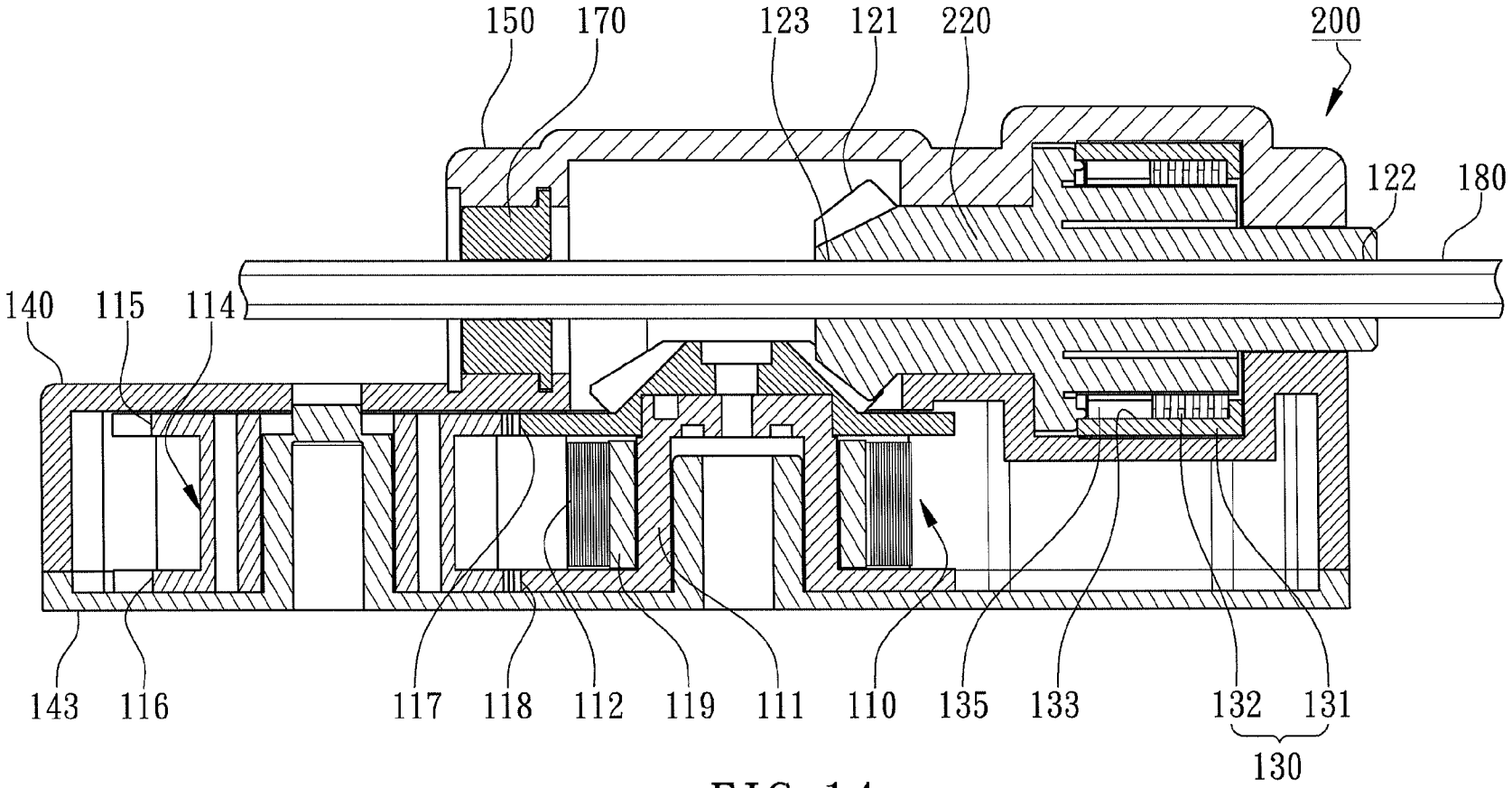
FIG. 14 is an axially cross-sectional view of the control device according to the second embodiment of the present invention.
Figure 15:
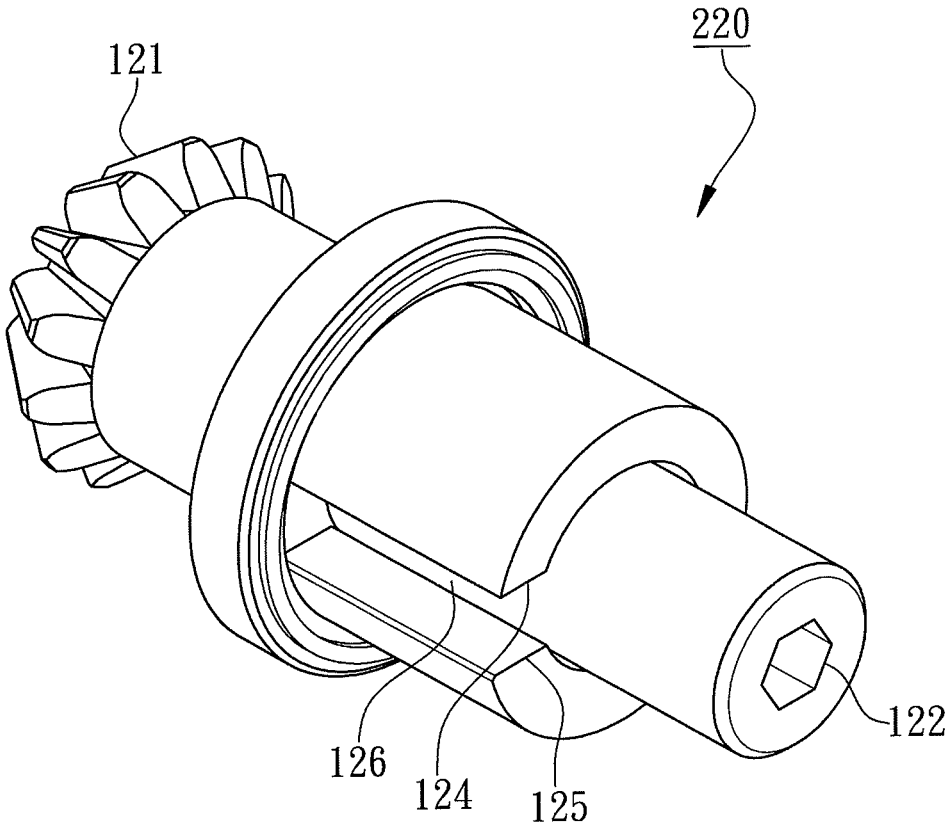
FIG. 15 is a three-dimensional view of a shaft connector of the control device according to the second embodiment of the present invention.

According to the second embodiment of the present invention, another control device 200 for a cordless blind with willful stop is illustrated in FIG. 13 for a three-dimensional view and in FIG. 14 for a cross-sectional view. The control device 200 primarily comprises a force-return mechanism 110, a shaft connector 220, and a braking buffer mechanism 130 where a three-dimensional view of the shaft connector 220 is shown in FIG. 15. The components of the force-return mechanism 110 and the braking buffer mechanism 130 are the same as described in the first embodiment with the same figure numbers which will not be explained in detail again except necessary technical characters.

The force-return mechanism 110 is installed inside a housing 140. The force-return mechanism 110 at least includes a flat spring bevel gear 111 and an elastic element 112 where one end of the elastic element 112 is connected to the flat spring bevel gear 111 to provide the retracting force of the flat spring bevel gear 111. The shaft connector 220 is also installed inside the housing 140. One end of the shaft connector 220 has a transmission bevel gear 121 where the transmission bevel gear 121 is meshed with the bevel gear 113 of the flat spring bevel gear 121 and the other end of the shaft connector 220 has a first inserting opening 122. The braking buffer mechanism 130 is installed inside the housing 140. The braking buffer mechanism 130 includes a friction ring 131 and an impeding spring 132 where the friction ring 131 is firmly fixed inside the housing 140 with a wear-proof annular inwall 133 and the impeding spring 132 is tightly plugged into the friction ring 131 with an extrusion 134 to prevent the rotation of the transmission bevel gear 121. With this structure, a cordless blind using one or more of the control device 200 is able to stop at any position during lifting/lowering operation with less force.

In the present embodiment, the shaft connector 220 is formed in a unibody structure where the shaft connector 220 has a trigger 124 and a brake 125 which of both are disposed between the transmission bevel gear 121 and the first inserting opening 122. For example, the brake 125 and the trigger 124 are formed from two opposing sidewalls of an axial channel of the shaft connector 220 where the extrusion 134 is located at the gap 126 between the trigger 124 and the brake 125 formed by the axial channel. Moreover, the trigger 124 and the brake 125 are assembled with the impeding spring 132 in a manner that the friction between the impeding spring 132 and the friction ring 131 is reduced when the trigger 124 is in contact with the extrusion 134. For example, when the trigger 124 contacts the extrusion 134, the impeding spring 132 is stretched with slightly increase of coil counts to relatively make the diameter of the impeding spring 132 smaller so that the friction between the impeding spring 132 and the friction ring 131 can be reduced. Since the shaft connector 220 is formed in the unibody structure, the structure strength of the shaft connector 220 can be enhanced and the cost of the shaft connector 220 can be reduced.

As shown in FIG. 14, preferably, the first inserting opening 122 axially penetrates through the shaft connector 220 to the transmission bevel gear 121 to form a second inserting opening 123. By implementing the above described structure, the blind transmission rod 180 is able to penetrate through the shaft connector 220 so that the blind transmission rod 180 is able to connect to a plurality of control devices 200 for a cordless blind with willful stop. Therefore, increasing the number of control devices 200 is a solution to meet the requirements of heavier or larger cordless blinds without redesigning the control device for a cordless blind with willful stop to achieve universal modularized installation.

The above description of embodiments of this invention is intended to be illustrative but not limited. Other embodiments of this invention will be obvious to those skilled in the art in view of the above disclosure which still will be covered by and within the scope of the present invention even with any modifications, equivalent variations, and adaptations.

What is claimed is:

1. A control device for a cordless blind with a willful stop, comprising:

a force-return mechanism installed inside a housing, the force-return mechanism including a flat spring bevel gear and an elastic element, wherein one end of the elastic element is connected to the flat spring bevel gear to provide a retracting force of the flat spring bevel gear;

a shaft connector installed inside the housing, wherein one end of the shaft connector has a transmission bevel gear meshed with a bevel gear of the flat spring bevel gear, and the other end of the shaft connector has a first inserting opening;

a braking buffer mechanism installed inside the housing and including a friction ring and an impeding spring, wherein the friction ring is immovably fixed inside the housing with a wear-proof annular inwall and the impeding spring is tightly plugged into the wear-proof annular inwall with an extrusion to prevent the rotation of the transmission bevel gear; and a shell integrated to the housing to form a first chamber and a second chamber, wherein the braking buffer mechanism is accommodated in the first chamber and the flat spring bevel gear and the transmission bevel gear are accommodated in the second chamber, wherein the shaft connector penetrates through the first chamber and the second chamber of the housing until the first inserting opening is exposed from an opening formed by the combination of the housing and the shell;

wherein the shaft connector has a trigger and a brake adjacent to the other end of the shaft connector opposing to the transmission bevel gear in a manner that the trigger and the brake of the shaft connector are accommodated in the first chamber;

wherein the brake is in contact with the extrusion of the impeding spring with an original friction force formed between the impeding spring and the friction ring when the cordless blind is stopped; wherein the trigger is in contact with the extrusion of the impeding spring to reduce the original friction force formed between the impeding spring and the friction ring when the cordless blind is lifted.

2. The control device as claimed in claim 1, wherein the shaft connector comprises a first separating element and a second separating element, wherein the transmission bevel gear and the trigger are disposed on the first separating element, wherein the first inserting opening is formed on the second separating element and penetrates through an axis of the first separating element to connect with a second inserting opening on the transmission bevel gear, wherein the brake is disposed on the second separating element and the extrusion is located at the gap between the trigger and the brake.

3. The control device as claimed in claim 2, wherein the second inserting opening is formed at an axis of the transmission bevel gear, wherein the second inserting opening is axially connected with the first inserting opening.

4. The control device as claimed in claim 2, wherein the brake and the trigger are two sidewalls of separated extruded arcs facing to each other.

5. The control device as claimed in claim 1, wherein the shaft connector is formed in a unibody structure, wherein the trigger and the brake are disposed between the transmission bevel gear and the first inserting opening, the extrusion is located at the gap between the trigger and the brake.

6. The control device as claimed in claim 5, wherein the first inserting opening axially penetrates through the shaft connector to form a second inserting opening on an axis of the transmission bevel gear.

7. The control device as claimed in claim 5, wherein the brake and the trigger are formed from two opposing sidewalls of an axial channel of the shaft connector.

8. The control device as claimed in claim 2, wherein the extrusion is a protrusion sticking out toward an axis of the impeding spring, wherein the trigger and the brake are inserted through the impeding spring.

9. The control device as claimed in claim 1, wherein the braking buffer mechanism further includes a restraining ring inserted at an opening end of the wear-proof annular inwall to prevent the impeding spring to drop out.

10. The control device as claimed in claim 1, wherein at least an alignment fillister is axially formed on an external sidewall of the friction ring.

11. The control device as claimed in claim 1, further comprising a guiding element disposed between the housing and the shell, wherein the guiding element has a guiding hole which is axially aligned to the first inserting opening.

12. The control device as claimed in claim 11, further comprising a blind transmission rod penetrating through the guiding element and the shaft connector and sticks out from the first inserting opening and the guiding hole, wherein the shape of the first inserting opening is corresponding to the shaft of the blind transmission rod which is not circular.

13. The control device as claimed in claim 12, further comprising a transmission motor connected to one end of the blind transmission rod.

14. The control device as claimed in claim 1, wherein the elastic element is a coil spring and the force-return mechanism further includes a reed gear where the other end of the elastic element is connected to the reed gear.

15. The control device as claimed in claim 14, wherein a first gear and a second gear are installed respectively on top of and on bottom of the reed gear and wherein a third gear is installed at the periphery of the bevel gear of the flat spring bevel gear and a fourth gear is installed under the flat spring bevel gear, wherein the first gear is meshed with the third gear and the second gear is meshed with the fourth gear so that the elastic element is confined between the top meshed plane formed by the first gear and the third gear and the bottom meshed plane formed by the second gear and the fourth gear.

* * * * *